US010720715B2

(12) United States Patent
Abiri et al.

(10) Patent No.: US 10,720,715 B2
(45) Date of Patent: Jul. 21, 2020

(54) HIGHLY EFFICIENT MULTI-PORT RADIATAOR

(71) Applicant: California Institute of Technology, Pasadena, CA (US)

(72) Inventors: Behrooz Abiri, Pasadena, CA (US); Seyed Ali Hajimiri, Pasadena, CA (US); Florian Bohn, Pasadena, CA (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 55 days.

(21) Appl. No.: 15/897,054

(22) Filed: Feb. 14, 2018

(65) Prior Publication Data

US 2018/0277961 A1 Sep. 27, 2018

Related U.S. Application Data

(60) Provisional application No. 62/458,726, filed on Feb. 14, 2017, provisional application No. 62/556,686, filed on Sep. 11, 2017.

(51) Int. Cl.

| | |
|---|---|
| ***H01Q 21/00*** | (2006.01) |
| ***H01Q 1/22*** | (2006.01) |
| ***H01Q 23/00*** | (2006.01) |
| ***H01Q 21/06*** | (2006.01) |
| *H01Q 13/10* | (2006.01) |

(52) U.S. Cl.

CPC ..... *H01Q 21/005* (2013.01); *H01Q 1/2283* (2013.01); *H01Q 21/064* (2013.01); *H01Q 23/00* (2013.01); *H01Q 13/10* (2013.01)

(58) Field of Classification Search

CPC ..... H01Q 21/005; H01Q 21/0064

See application file for complete search history.

(56) References Cited

U.S. PATENT DOCUMENTS 5,757,329 A 5/1998 Hoover et al.
6,151,310 A 11/2000 Dent (Continued)

OTHER PUBLICATIONS

"Horn Antenna Calculator," *RF Wireless World*, 4 pages, (2012). [Retrieved from the Internet Mar. 9, 2018: http://www.rfwireless-world.com/calculators/Horn-Antenna-Calculator.html] [Author Unknown].

(Continued)

*Primary Examiner* — Daniel Munoz
(74) *Attorney, Agent, or Firm* — Alston & Bird LLP

(57) ABSTRACT

A radiator is formed by forming a multitude of slot antennas adjacent one another such that the spacing between each pair of adjacent slot antennas is smaller than the wavelength of the signal being transmitted or received by the radiator. The radiator achieves high efficiency by reducing the excitation of substrate modes, and further achieves high output power radiation by combining power of multiple CMOS power amplifiers integrated in the radiator structure. Impedance matching to low-voltage CMOS power amplifiers is achieved through lowering the impedance at the radiator ports. Each output power stage may be implemented as a combination of several smaller output power stages operating in parallel, thereby allowing the combination to utilize an effective output device size commensurate with the impedance of the radiator.

14 Claims, 4 Drawing Sheets

(56) References Cited

U.S. PATENT DOCUMENTS

| | | | | |
|---|---|---|---|---|
| 6,535,173 | B2 | 3/2003 | Ou | |
| 8,149,177 | B1 | 4/2012 | Callus et al. | |
| 8,285,230 | B2 | 10/2012 | Komori | |
| 2005/0140556 | A1* | 6/2005 | Ohno | H01Q 13/20 343/770 |
| 2017/0187124 | A1* | 6/2017 | Kirino | H01Q 13/20 |

OTHER PUBLICATIONS

Babakhani et al., "A 77GHz 4-Element Phased Array Receiver with On-Chip Dipole Antennas in Silicon," IEEE International Solid-State Circuits Conference (ISSCC), pp. 629-638, (2006).

Bowers et al., "An Integrated Traveling-wave Slot Radiator," IEEE Radio Frequency Integrated Circuits Symposium (RFIC), pp. 369-372, (2014).

Chappidi et al., "A Frequency-Reconfigurable Mm-Wave Power Amplifier with Active-Impedance Synthesis in an Asymmetrical Non-Isolated Combiner," ISSCC, pp. 344-345, Feb. 2016.

Chen et al., "A 94 GHz 3D-image radar engine with 4TX/4RX beamforming scan technique in 65nm CMOS," ISSCC, pp. 146-147, (2013).

Chi et al., "17.3 a 60GHz on-chip linear radiator with single-element 27.9dBm Psat and 33.1dBm peak EIRP using multifeed antenna for direct on-antenna power combining," ISSCC, pp. 296-297, (2017).

Natarajan et al., "A 77GHz Phased-Array Transmitter with Local LO-Path Phase-Shifting in Silicon," ISSCC, pp. 639-648, (2006).

Sadhu et al., "A 60GHz packaged switched beam 32nm CMOS TRX with broad spatial coverage, 17.1dBm peak EIRP, 6.1dB NF at < 250mW," RFIC, pp. 342-343, (2016).

Shin et al., "A 108-114 GHz 4x4 Wafer-Scale Phased Array Transmitter With High-Efficiency On-Chip Antennas," *IEEE Journal of Solid-State Circuits*, 48(9):2041-2055, (2013).

WIPO Application No. PCT/US2018/018239, International Search Report and Written Opinion of the International Searching Authority, dated May 3, 2018.

* cited by examiner

HIGHLY EFFICIENT MULTI-PORT RADIATAOR

CROSS REFERENCE TO RELATED APPLICATIONS

The present application claims benefit under 35 USC 119 (e) of U.S. provisional Application No. 62/458,726, filed Feb. 14, 2017, entitled "Highly Efficient Multi-Port Radiators", and U.S. provisional Application No. 62/556,686 filed Sep. 11, 2017, entitled "Highly Efficient Multiport Radiators: High-Efficiency Operation at Power Backoff and Apodization in Array Operation", the contents of both which are incorporated herein by reference in their entirety.

FIELD OF THE INVENTION

The present invention relates to antennas, and more particularly to slot antennas.

BACKGROUND OF THE INVENTION

The emergence and development of sub 100 nm complementary metal-oxide semiconductor (CMOS) technology and the availability of high-speed metal-oxide semiconductor field-effect transistors (MOSFETs) in low cost silicon processes has resulted in the proliferation of CMOS technology for radio-frequency (RF) and wireless applications. With an ever increasing demand for higher data bandwidth, system performance and lower spectral occupancy and pressure to reduce overall system cost and form factors, CMOS wireless applications continue to move to increasingly higher RF frequencies, and well into the mm-wave regime.

Many applications, such as automotive radar and wireless communication systems such as WiMax, can greatly benefit and may utilizes ever faster silicon processes. Devices fabricated using CMOS processes, however, have inherently relatively lower output power. As the frequency increases, extracting the RF and mm-wave power from the integrated circuits (IC) becomes increasingly more challenging. The loss in the printed circuit board (PCB) substrates as well as the difficulty in modeling the exact interface of the CMOS IC and PCB has hindered the rate of progress.

On-chip antennas have been proposed to utilize the relatively inexpensive and reliable CMOS process to combat this difficulty and reduce the cost of fabrication of high frequency components required for mm-wave links. The main challenge in CMOS radiators is the loss associated with such radiators.

BRIEF SUMMARY OF THE INVENTION

A radiator, in accordance with one embodiment of the present invention, includes, in part, N slot antennas wherein the spacing between each pair of adjacent slot antennas is less than a wavelength of the electromagnetic signal being transmitted or received by the radiator. N is an integer equal to or greater than 2. In one embodiment, the spacing between each pair of adjacent slot antennas is equal to or less than ¾ of the wavelength of the electromagnetic signals being transmitted or received by the radiator. In another embodiment, the spacing between each pair of adjacent slot antennas is equal to or less than ½ of the wavelength of the electromagnetic signals being transmitted or received by the radiator.

In one embodiment, each slot antenna is driven by M amplifiers at M different drive points positioned along a length of the slot antenna. In one embodiment, the M drive points are distributed evenly and at equal distances along the length of the radiator. In one embodiment, each of the M amplifiers is a differential amplifier driving a pair of adjacent slot antennas.

In one embodiment, each of the M amplifiers is controlled by an associated switch adapted to place the amplifiers either in short, open or active state at any given time. In one embodiment, the N×M switches controlling the N×M amplifiers are controlled by a digital control block generating N×M digital signals each applied to a different one of the N×M switches. In one embodiment, each differential amplifier includes, in part, a pair of MOS transistors generating a pair of differential voltages applied to a pair of drive points positioned along a pair of associated adjacent slot antennas. In one embodiment, each switch is adapted to control voltages applied to gate terminals of its associated MOS transistors.

A method of radiating an electromagnetic signal, in accordance with one embodiment of the present invention, includes, in part, transmitting the electromagnetic signal from N slot antennas, wherein a spacing between each pair of adjacent slot antennas is less than a wavelength of the electromagnetic signal being transmitted, and wherein N is an integer equal to or greater than 2. In one embodiment, the spacing between each pair of adjacent slot antennas is equal to or less than ¾ of the wavelength of the electromagnetic signals being transmitted or received by the radiator. In another embodiment, the spacing between each pair of adjacent slot antennas is equal to or less than ½ of the wavelength of the electromagnetic signals being transmitted or received by the radiator.

The method, in accordance with one embodiment, further includes, in part, driving each slot antenna by M amplifiers at M different drive points positioned along a length of that slot antenna. In one embodiment, the M drive points are distributed evenly and at equal distances along the length of the radiator. In one embodiment, each of the M amplifiers is a differential amplifier driving a pair of adjacent slot antennas.

The method, in accordance with one embodiment, further includes, in part, controlling each of the M amplifiers by an associated switch adapted to place the amplifiers either in short, open or active state at any given time. The method, in accordance with one embodiment, further includes, in part, controlling the N×M switches that control the N×M amplifiers by a digital control block generating N×M digital signals each applied to a different one of the N×M switches. In one embodiment, each differential amplifier includes, in part, a pair of MOS transistors generating a pair of differential voltages applied to a pair of drive points positioned along a pair of associated adjacent slot antennas. In one embodiment, each switch is adapted to control voltages applied to gate terminals of its associated MOS transistors.

DETAILED DESCRIPTION OF THE INVENTION

In accordance with embodiments of the present invention, a multi-port on-chip radiator achieves high efficiency by reducing the excitation of substrate modes, and further achieves high output power radiation by combining power of multiple CMOS power amplifiers in the radiator (antenna) structure. Furthermore, impedance matching to low-voltage CMOS power amplifiers is achieved through lowering the antenna impedance at the ports.

In addition, embodiments of the present invention allow for presenting real and varying impedances to the output power stages by selectively bypassing, turning off or driving one or more output power stages. This enables the operation of the power amplifier stages at a highly efficient operating point even at power levels below the maximum output power.

Furthermore, each output power stage can be implemented as a combination of several smaller output power stages operating in parallel, thereby allowing the combination to utilize an effective output device size commensurate with the impedance presented by the antenna. This further increases the performance of the output power stages. The different stages can be co-located along the antenna structure further improving the drive point impedance and, hence, performance of the overall radiator. In this way, a quasi-digital operation of the array can be achieved.

In accordance with one embodiment of the present invention, a radiator is formed by forming a multitude of slot antennas adjacent one another such that the spacing between each pair of adjacent slot antennas is smaller than the wavelength of the signal being transmitted or received. In one embodiment, the spacing between each pair of adjacent slot antennas is equal to or smaller than ¾ of the wavelength of the signal being transmitted or received. In another embodiment, the spacing between each pair of adjacent slot antennas is equal to or smaller than ½ of the wavelength of the signal being transmitted or received. For example, when the radiator includes only two slot antennas, the coupling of the excitation at a first port to the second port of the radiator opposes the excitation, thereby increasing the current flowing to the driver of the second port and thus reducing the output driving impedance of the radiator.

Figure 1A:
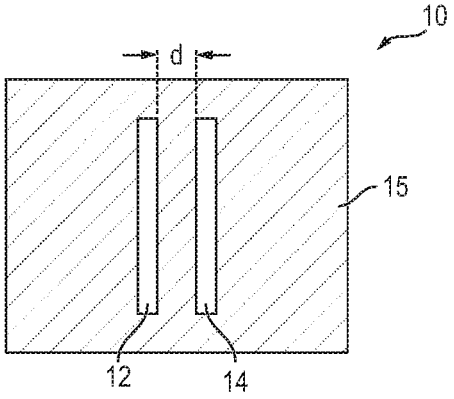
FIG. 1A is a simplified schematic view of a radiator having a multitude of slot antennas, in accordance with one exemplary embodiment of the present invention.

FIG. 1A is a schematic diagram of a radiator 10 having two slot antennas 12 and 14, in accordance with one exemplary embodiment of the present invention. The spacing d between the two slots is smaller than the wavelength of the signal being transmitted by radiator 10. Layer 15 in which slot antennas 12 and 14 are formed is a metal layer. In one embodiment, the spacing between slot antennas 12 and 14 is equal to or smaller than ¾ of the wavelength of the signal being transmitted or received by the slot antennas. In another embodiment, the spacing between slot antennas 12 and 14 is equal to or smaller than ½ of the wavelength of the signal being transmitted or received by the slot antennas.

Figure 1B:
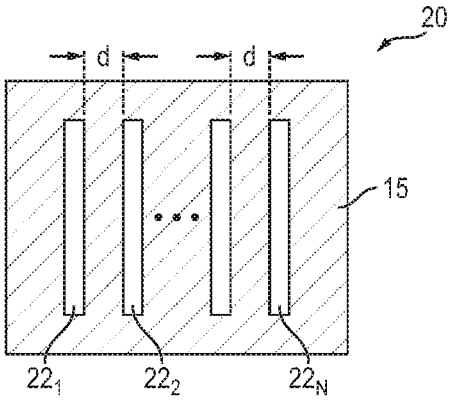
FIG. 1B is a simplified schematic view of a radiator having a multitude of slot antennas, in accordance with another exemplary embodiment of the present invention.

FIG. 1B is a schematic diagram of a radiator 20 having N slot antennas $\mathbf{22}_1$, $\mathbf{22}_2 \ldots \mathbf{22}_N$, where N is an integer greater than or equal to 2, in accordance with another exemplary embodiment of the present invention. The distance between each pair of adjacent slot antennas, e.g., $\mathbf{22}_1$, $\mathbf{22}_2$, or, e.g. $\mathbf{22}_{N-1}$, $\mathbf{22}_N$ is the same and is selected to be smaller than the wavelength of the electromagnetic wave being transmitted by radiator 20. In one embodiment, the spacing between each pair of adjacent slot antennas is equal to or smaller than ¾ of the wavelength of the signal being transmitted or received by the slot antennas. In another embodiment, the spacing between each pair of adjacent slot antennas is equal to or smaller than ½ of the wavelength of the signal being transmitted or received by the slot antennas.

Figure 2:
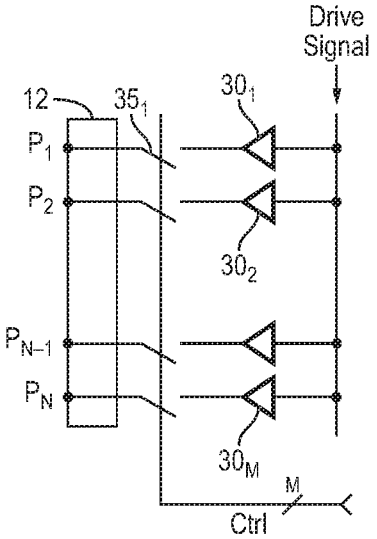
FIG. 2 is a simplified schematic view of a slot antenna driven by M amplifiers, in accordance with one exemplary embodiment of the present invention.

In accordance with one aspect of the present invention, each slot antenna is driven by one or more amplifiers. For example, FIG. 2 shows a slot antenna disposed in an array in accordance with one embodiment of the present invention and being driven by M amplifiers $\mathbf{30}_1$, $\mathbf{30}_2 \ldots \mathbf{30}_M$. Switches $\mathbf{35}_1$, $\mathbf{35}_2 \ldots \mathbf{30}_M$, each associated with a different one of amplifiers $\mathbf{30}_1$, $\mathbf{30}_2 \ldots \mathbf{30}_M$, are controlled by M-bit control signal Ctrl[1:M], such that, for example, bit 1 of signal Ctrl is applied to switch $\mathbf{35}_1$ and bit M of signal Ctrl is applied to switch 35M. In one embodiment, points $P_1$, $P_2 \ldots P_M$ of the slot antenna driven respectively by amplifiers $\mathbf{30}_1$, $\mathbf{30}_2 \ldots \mathbf{30}_M$ are distributed evenly across the length L of slot antenna 12. In other words, in one embodiment, the distance between drive point $P_1/P_2$ is the same as that between drive points $P_2/P_3$ or $P_{N-1}/P_N$.

Figure 3A:
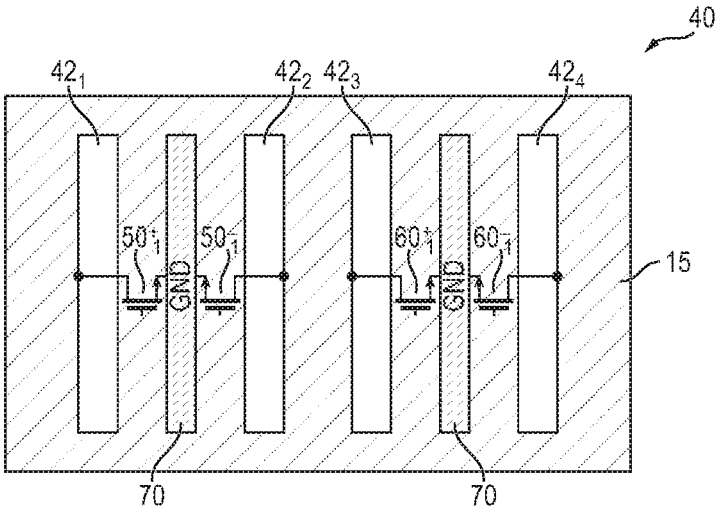
FIG. 3A is a simplified schematic view of a multi-slot antenna radiator, in accordance with one exemplary embodiment of the present invention.

In accordance with some embodiments of the present invention, each drive amplifier $\mathbf{30}_j$, where j is an index ranging from 1 to M, is a differential amplifier adapted to supply signals to a pair of adjacent slot antennas. FIG. 3A shows a multi-slot radiator 40 having 4 slot antennas $\mathbf{42}_1$, $\mathbf{42}_2$, $\mathbf{42}_3$ and $\mathbf{42}_4$, in accordance with one exemplary embodiment of the present invention. Slot antennas $\mathbf{42}_1$, $\mathbf{42}_2$ are driven by a first differential amplifier only output transistors of which, namely output transistors $\mathbf{50}_1^+$ and $\mathbf{50}_1^-$ are shown for simplicity. Similarly, slot antennas $\mathbf{42}_3$, $\mathbf{42}_4$ are driven by a second differential amplifier only output transistors of which, namely output transistors $\mathbf{60}_1$+ and $\mathbf{60}_1^-$ are shown for simplicity. Metal lines 70 are ground terminals positioned below metal layer 15, as described further below.

Figure 3B:
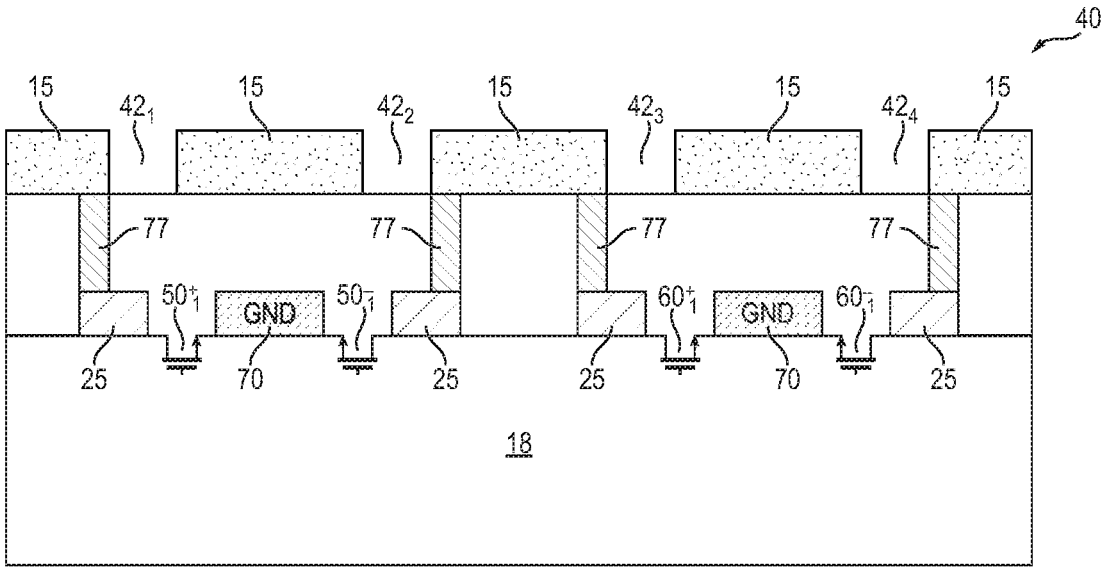
FIG. 3B is a cross-sectional view of the radiator shown in FIG. 3A, in accordance with one exemplary embodiment of the present invention.

FIG. 3B is a cross-sectional view of radiator 40 shown in FIG. 3A. In FIG. 3B, for simplicity, transistors are shown using a transistor symbol and without all their various semiconductor layers/junctions. Vias 77 are shown as connecting slots $\mathbf{42}_1$, $\mathbf{42}_2$, $\mathbf{42}_3$, $\mathbf{42}_4$ formed in metal layer 15 to drain terminals of transistors $\mathbf{50}_1^+$, $\mathbf{50}_1^-$, $\mathbf{60}_1^+$ and $\mathbf{60}_1^-$. As is also shown, the source terminals of $\mathbf{50}_1^+$, $\mathbf{50}_1^-$, $\mathbf{60}_1^+$ and $\mathbf{60}_1^-$ are coupled to ground terminal 70.

Figure 4:
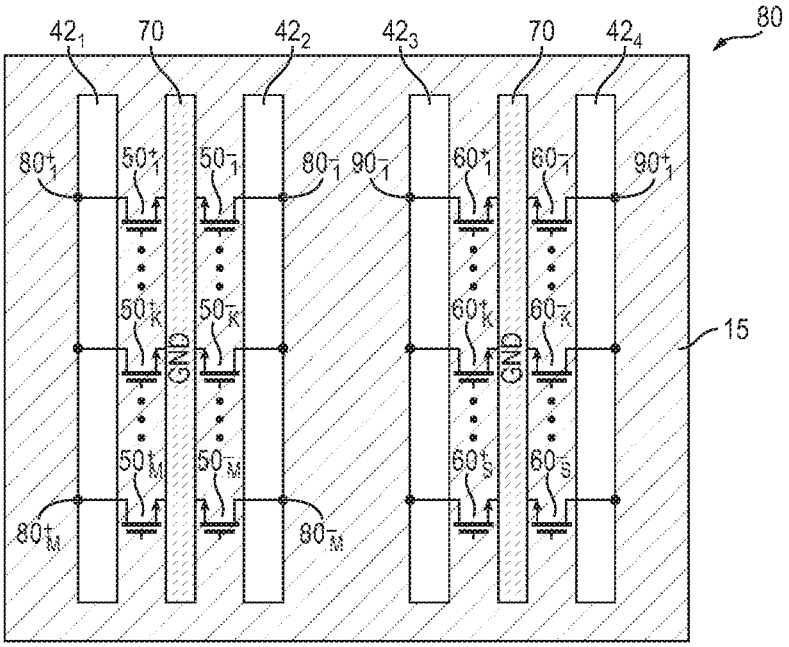
FIG. 4 is a simplified schematic view of a multi-slot antenna radiator, in accordance with one exemplary embodiment of the present invention.

FIG. 4 shows a multi-slot radiator 80 having 4 slot antennas $\mathbf{42}_1$, $\mathbf{42}_2$, $\mathbf{42}_3$ and $\mathbf{42}_4$, in accordance with another exemplary embodiment of the present invention. Slot antennas $\mathbf{42}_1$, $\mathbf{42}_2$ are driven by M differential amplifiers (not shown in full for clarity and simplicity). Transistors $\mathbf{50}_1^+$ and $\mathbf{50}_1^-$ are the differential output transistors of the first differential amplifier driving slot antennas $\mathbf{42}_1$, $\mathbf{42}_2$. Transistors $\mathbf{50}_K^+$ and $\mathbf{50}_K^-$ are the differential output transistors of the $K^{th}$ differential amplifier driving slot antennas $\mathbf{42}_1$, $\mathbf{42}_2$. Transistors $\mathbf{50}_M^+$ and $\mathbf{50}_M^-$ are the differential output transistors of the $M^{th}$ differential amplifier driving slot antennas $\mathbf{42}_1$, $\mathbf{42}_2$, wherein K and M are integers greater than one and K is smaller than M.

Similarly, slot antennas $\mathbf{42}_3$, $\mathbf{42}_4$ are driven by S differential amplifier (not shown in full for clarity and simplicity). Transistors $\mathbf{60}_1^+$ and $\mathbf{60}_1^-$ are the differential output transistors of the first differential amplifier driving slot antennas $\mathbf{42}_3$, $\mathbf{42}_4$. Transistors $\mathbf{60}_K^+$ and $\mathbf{60}_K^-$ are the differential output transistors of the $K^{th}$ differential amplifier driving slot antennas $\mathbf{42}_3$, $\mathbf{42}_4$. Transistors $\mathbf{60}_S^+$ and $\mathbf{60}_S^-$ are the differential output transistors of the $S^{th}$ differential amplifier driving slot antennas $\mathbf{42}_3$, $\mathbf{42}_4$. Although FIGS. 3A and 4 show a radiator with 4 slot antennas, it is understood that a radiator, in accordance with the present invention many have any number N of slot antennas. The number of differential amplifiers driving each pair of adjacent slot antennas (such as M or S) may or may not be equal to the number of slot antennas N forming the radiator. In some embodiments, M and S are equal.

Figure 5:
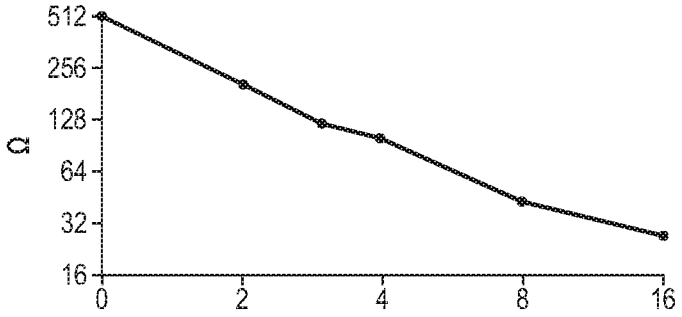
FIG. 5 shows computer simulation of the driving impedance of a multi-slot antenna radiator as a function of the number of slot antennas disposed in the radiator, in accordance with one exemplary embodiment of the present invention.
Figure 6:
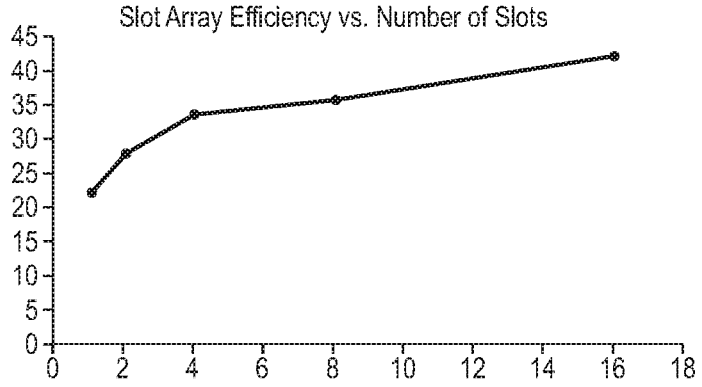
FIG. 6 shows computer simulation of the efficiency of a multi-slot antenna radiator as a function of the number of slot antennas disposed in the radiator, in accordance with one exemplary embodiment of the present invention.

FIG. 5 shows computer simulation of the driving impedance of the radiator as a function of the number of antenna slot antennas disposed in the radiator. As is seen from FIG. 5, as the number of slot antennas increases, the coupling from other ports results in lower driver impedance for each port. Because the impedance of the antenna port (also referred to as driving point) is reduced by increasing the number of slots, more RF is coupled into the antenna per port. Therefore, a multi-slot antenna radiator, in accordance with embodiments of the present invention, not only increases the output power by combining more power amplifiers, but also enables higher power amplifiers per port without complicating the matching network impedance. Furthermore, a multi-slot antenna radiator, in accordance with embodiments of the present invention, reduces the excitation of substrate modes since each slot antenna cancels the field, thereby increasing efficiency of the radiator shown from FIG. 6.

Referring to FIG. 4, the driving port impedance is a function of the number of closely placed slot antennas (alternatively referred to herein as slots). The effective number of slots may be controlled electronically either (i) actively by providing a desired RF drive with a particular phase and amplitude or (ii) passively by providing a particular impedance—such as an open or short circuit.

Table I below shows the simulation results for an 8-slot radiator, with each pair of adjacent slots driven by one or more pairs of differential amplifiers, as shown for example, in FIG. 3A or 4. In Table I, N represents the number of slot antennas driven, R represents the parallel average port resistance R (inverse of port conductance), $P_{OUT}$ represents the fraction of output power normalized for the case N=8 and $P_{db}$ represents the fraction of output power in decibels normalized for the case N=8.

TABLE I

| N | R | $P_{OUT}$ | $P_{db}$ |
|---|---|---|---|
| 8 | 60.4 | 1 | 0.0 |
| 7 | 66.9 | 0.79 | −1.0 |
| 6 | 76.9 | 0.59 | −2.3 |
| 5 | 90.2 | 0.42 | −3.8 |
| 4 | 111.9 | 0.27 | −5.7 |
| 3 | 146.4 | 0.15 | −8.1 |
| 2 | 219.5 | 0.069 | −11.6 |
| 1 | 433.9 | 0.017 | −17.0 |

It is understood, that in accordance with embodiments of the present invention, only a subset of the slots of a multi-slot radiator may be driven at any given time to meet the power and output impedance transmission requirements. It is further understood, that only a subset of the amplifiers connected to each slot antenna may be activated at any given time to meet the power and output impedance transmission requirements. Moreover, the various ports and/or slots of a multi-slot radiator may or may not be driven with the same amplitude and/or phase.

Each slot antenna drive point may be short circuited by providing a DC "high" signal to the input of the power amplifier driving the antenna port. For example, referring to FIG. 4, drive points $\mathbf{80}_1^+$ and $\mathbf{80}_1^-$ may be short circuited by applying a relatively high voltage to the gate terminals of transistors $\mathbf{50}_1^+$ and $\mathbf{50}_1^-$. Similarly by applying, a relatively "high" DC bias voltage to the gate terminals of all transistors $\mathbf{50}_i^+$, where i is an index ranging from 1 to M in the example shown in FIG. 4, slot antenna $\mathbf{42}_1$ is short circuited to, e.g., the ground potential.

Referring to Table I and comparing it to FIG. 5, it is seen that, when (8−N) antennas are shorted, the effect is almost similar to not having the slots present as the impedance (column R) scales almost proportionally with $$\frac{N_0}{N}$$

where $N_0$ is eight in this example. As fewer antennas are driven, the total amount of output power is reduced because both the number of antennas that transmit power as well as the power transmitted per antenna are reduced, due to the drive point impedance compared to the base case when $N_0$ is equal 8.

Mathematically, $P_{OUT}$ (alternatively referred to herein as P) may be defined as:

$$P \approx P_0 \frac{N}{N_0} \frac{R_0}{R}$$

In the above expression $P_0$ represents the power transmitted when all antennas are excited, N represents the number of antennas being driven, $R_0$ represents the impedance of each antenna when all antennas are driven, and $$R \approx R_0 \frac{N_0}{N}.$$

Therefore $$P \approx P_0 \frac{N^2}{N_0^2}.$$

Thus, by shorting, e.g., half of a given number of ports, the output power is reduced by a factor of, e.g., 4 (equivalent to −6 dB). In deriving the above relationships, which are approximations, the slots are assumed to be have close coupling and edge effects are ignored.

The reactive portion of the drive point impedance control described herein is not affected substantially by shorting different number of antennas. This effect may be expressed as the quality factor, or Q-factor, of the driving point impedance, which is known as the ratio of the reactanc X over the resistance R; in other words Q=X/R.

A Q-factor of zero means the load is purely resistive, while a high Q-factor means that the load is mainly reactive. For the example shown in Table I above, the Q-factors for the cases N=1 . . . 8 are tabulated in Table II below at the nominal center frequency.

TABLE II

| N | Q |
|---|---|
| 8 | 0.16 |
| 7 | 0.10 |
| 6 | 0.06 |
| 5 | 0.00 |
| 4 | 0.05 |
| 3 | 0.12 |
| 2 | 0.16 |
| 1 | 0.30 |

This property is useful in practical applications using practical components, as amplifiers typically prefer a low-Q factor (real load) and operate well with them. In addition, this makes the use of parallel amplifiers as shown in FIG. 4 highly practical, as each amplifier may be designed to operate at a high resistive load. By using multiple amplifiers in parallel, the optimum load is lowered proportional to the number of amplifiers operated in parallel.

Figure 7:
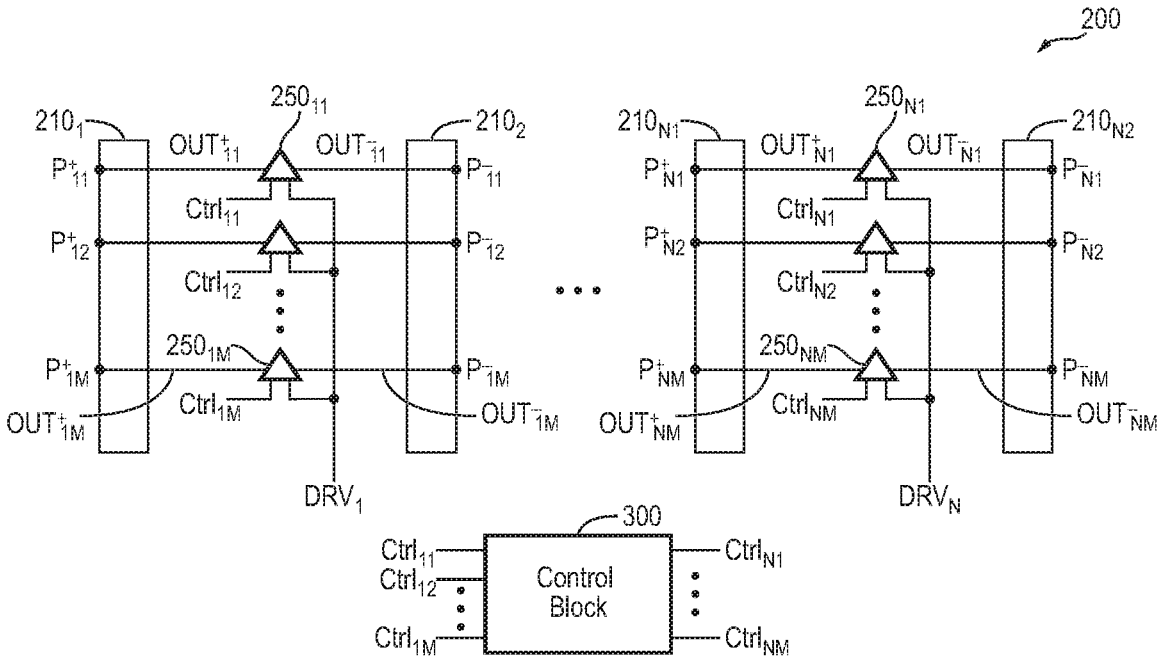
FIG. 7 is a simplified schematic view of a multi-slot antenna radiator, in accordance with another exemplary embodiment of the present invention.

FIG. 7 is a block diagram of a radiator 200 having disposed therein N slot antennas $\mathbf{210}_1$, $\mathbf{210}_2$ . . . $\mathbf{210}_N$, where N is an integer equal to or greater than 4 in this example. Each of slot antennas $\mathbf{210}_1$ and $\mathbf{210}_2$ is driven at M points by M different differential amplifiers $\mathbf{250}_{11}$, $\mathbf{250}_{12}$ and $\mathbf{250}_{1M}$. For example, differential amplifier $\mathbf{250}_{11}$ is shown as supplying differentially positive voltage $OUT_{11}^+$ at point $P_{11}^+$ of slot antenna $\mathbf{210}_1$, and supplying differentially negative voltage $OUT_{11}^-$ at point $P_{11}^-$ of slot antenna $\mathbf{210}_2$. Likewise, differential amplifier $\mathbf{250}_{1M}$ is shown as supplying differentially positive voltage $OUT_{IM}^+$ at point $P_{1M}^+$ of slot antenna $\mathbf{210}_1$, and supplying differentially negative voltage $OUT_{IM}^+$ at point $P_{1M}^-$ of slot antenna $\mathbf{210}_2$.

In a similar manner each of slot antennas $\mathbf{210}_{N-1}$ and $\mathbf{210}_N$ is driven at M points by M different differential amplifiers $\mathbf{250}_{N1}$, $\mathbf{250}_{N2}$ and $\mathbf{250}_{NM}$. For example, differential amplifier $\mathbf{250}_{N1}$ is shown as supplying differentially positive voltage $OUT_{N1}^+$ at point $P_{N1}^+$ of slot antenna $\mathbf{210}_{N-1}$, and supplying differentially negative voltage $OUT_{N1}^-$ at point $P_{N1}^-$ of slot antenna $\mathbf{210}_N$. Likewise, differential amplifier $\mathbf{250}_{NM}$ is shown as supplying differentially positive voltage $OUT_{NM}^+$ at point $P_{NM}^+$ of slot antenna $\mathbf{210}_{N-1}$, and supplying differentially negative voltage $OUT_{NM}^-$ at point $P_{NM}^-$ of slot antenna $\mathbf{210}_N$. Although not shown, other pairs of slot antennas disposed in radiator 200 may be similarly arranged and configured.

Figure 8:
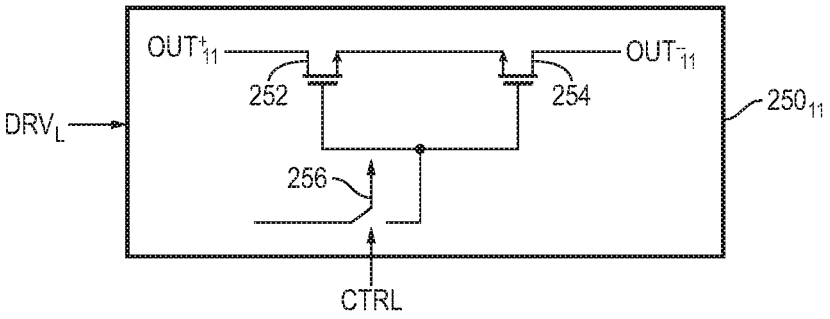
FIG. 8 shows output transistors and a switch disposed in one of the amplifiers disposed in the radiator of FIG. 7, in accordance with another exemplary embodiment of the present invention.

Amplifiers $\mathbf{250}_{11}$, $\mathbf{250}_{12}$ . . . $\mathbf{250}_{1M}$ are driven by signal $DRV_1$. Similarly, amplifiers $\mathbf{250}_{N1}$, $\mathbf{250}_{N2}$ . . . $\mathbf{250}_{NM}$ are driven by signal $DRV_N$. Furthermore, each of the amplifiers driving the slot antennas $\mathbf{210}_1$ and $\mathbf{210}_2$ receives a different control signal. For example, amplifier $\mathbf{250}_{11}$ receives control signal $Ctrl_{11}$ and amplifier $\mathbf{250}_{1M}$ receives control signal $Ctrl_{1M}$. Likewise, amplifier $\mathbf{250}_{N1}$ receives control signal $Ctrl_{N1}$ and amplifier $\mathbf{250}_{NM}$ receives control signal $Ctrl_{NM}$. In one embodiment, the control signal applied to each amplifier controls whether to drive the slot antenna, or provide a short or an open circuit, as described further below. FIG. 7 also shows control block 300 which generates control signals $Ctrl_{ij}$, where i is an index ranging from 1 to N and j is an index ranging from 1 to M in this example FIG. 8 shows output transistors 252, 254 as well switch 256 disposed in amplifier $\mathbf{250}_{11}$. It is understood that amplifier $\mathbf{250}_{11}$ includes other components not shown in FIG. 8 for clarity. It is also understood that each other amplifier $\mathbf{250}_{ij}$ disposed in radiator 200 of FIG. 7 has similar output transistors and a switch as that shown in FIG. 8 and that operate in the same manner as described below with reference to FIG. 8.

In one embodiment, control signal applied $Ctrl_{11}$ places switch 256 in one of three positions. When placed in the first position (not shown), a high DC voltage is applied to the gate terminals of transistors 252 and 254, thereby causing signals $Out_{11}^+$ and $Out_{11}^+$ to be shorted to a ground terminal (not shown). When placed in the second position (not shown), the gate terminals of transistors 252 and 254 are left floating. When placed in the third position (not shown). The drive voltage $DRV_1$ causes transistors 252 and 254 to generate time-varying signals $Out_{11}^+$ and $Out_{11}^+$ applied to drive points $P_{11}^+$ and $P_{11}^-$ of slot antennas $\mathbf{210}_1$ and $\mathbf{210}_2$ shown in FIG. 7 thereby to drive antennas $\mathbf{210}_1$ and $\mathbf{210}_2$.

As described above, FIG. 7 shows a parallel combination of a multitude of amplifiers connected to the same slot antenna with additional control supplied by control block 300. As was further described above, such amplifiers may be selectively positioned in an "open circuit" state so as not to consume any power. This may be achieved if, for example, the voltage applied to the gate terminals of transistors 252 and 254 of FIG. 7 is set to a low enough voltage that prevents the transistors from conducting current. By applying a relatively high DC voltage to the gate terminals of transistors 252 and 254, the output signals $Out_{ij}^+$ and $Out_{1j}^-$ may be shorted to ground.

By controlling the number of parallel amplifiers driving each slot antenna as well as by controlling the number of slot antennas so driven, a highly practical, optimal driving point for the amplifiers, and therefore, a high range of achievable output powers for the slot antennas are achieved. Embodiments of the present invention thus enable each individual amplifier to drive the same or a substantially similar drive point impedance under all output power circumstances. Such a drive enables the amplifiers to operate with high power conversion efficiency. In other words, the amplifiers are adapted to operate under a low voltage standing wave ratio VSWR condition under various output power circumstances. As is known, a high VSWR refers to a driving point impedance that is far away from the optimum point and produces a highly inefficient amplifier operating condition, which embodiments of the present invention avoid.

Being able to generate a wide range of output powers with digital control and maintaining high power conversion efficiency has many implications for practical applications, as discussed further below. Other variations of passive as well as active drive scenarios may also be used. For example, in one embodiment, instead of providing a short circuit connection instead of an RF drive, an open circuit may be provided (typically by turning off the power amplifier driving the antenna). In another embodiment, different antennas can be driven with RF signals at different phases, providing an active control of the drive point impedance seen at each antenna. In yet other embodiments, circuitry that provides tunable loads such as electronically controlled variable reactances (commonly known as varactors), digitally switchable banks of passive components or similar circuitry can further extend and optimize the range of highly efficient operation.

As described in detail above, due to its configurability, a multi-slot radiator may be operated as a single element thus behaving as a single antenna, or in an array configuration where multiple slots are operated together in a phased- and amplitude coherent array. The configurability of the radiator which enables the radiated output power to be controlled digitally and which further maintain a highly efficient operating point renders the configurable multi-slot radiator suitable for many applications, such as, for example, signal amplitude modulation for data transmission (either as a single radiator or part of an array), adaptive output power control (either as a single radiator or part of an array), apodization of a phased-array beam, rectifier input power matching, tileable configuration of individual multiport radiators, fabrication of individual multiport radiators on the same semiconductor wafer, allowing die-sawing to select the number of used multiport radiator elements, and wafer scale multi-port radiator.

Signal Amplitude Modulation

Many modern signal modulation schemes, such as the various QAM schemes, e.g. 16QAM, 64QAM, 256QAM, or various APSK schemes, e.g. 16APSK, 32APSK, among others, vary the signal amplitude to encode information. At a reduced output amplitude, radio systems tend to operate at lower power conversion efficiencies, and various methods such as outphasing (e.g. LINC or Chireix amplifiers), Doherty amplifiers, envelope tracking amplifiers or envelope elimination and restoration techniques have been developed to provide better average power conversion efficiency. These problems are getting exacerbated as modulation schemes attempt to utilize ever more output power levels to conserve spectral bandwidth at ever increasing data rates. Embodiments of the present invention overcome many of these challenges by providing a nearly continuous and adjustable scheme to operate with high power conversion efficiency at many output power levels. Signal amplitudes can be modulated by one or more of a multitude of slots operated in a phased and/or amplitude coherent manner.

Adaptive Output Power Control

Many modern RF systems require output power to be adjusted to a level sufficient for operation in a particular environment. For example, a cellular phone may reduce its transmitted output power level if it's close to the base station to conserve battery life and reduce interference with other users. In current approaches, power conversion efficiency tends to drop at reduced output power levels. Embodiments of the present invention overcome this problem, both when the radiator is used as a single effective antenna as well as in a phased array configuration.

Applications for Array Apodization

It is well known that a typical phased array exhibits radiation in unwanted direction (i.e. have strong sidelobes), when the output power of elements across the array are the same. One known solution to this problem is to vary the output power across elements of the array, a technique known as apodization, which means that array elements in the center transmit more power compared to elements near the edge. Many suitable apodization functions (also known as windowing functions) are known that describe functionally how power can be adjusted across an array to achieve various goals, such as minimum sidelobe level. Other applications involve forming certain types of beams, such as Bessel beams that have certain advantageous characteristics. Because a configurable multi-slot antenna, in accordance with embodiments of the present invention, operate at a relatively high power conversion efficiency over a large and easily controllable number of output power levels, apodization in a phased array that uses embodiments of the present invention does not lead to significant system efficiency reduction.

Rectifier Input Power Matching

A multiport radiator can also be configured as a multiport receiver when the individual amplifiers are exchanged with RF-to-DC rectification circuits. Rectification operation is in some respects similar to power amplification operation in reverse, and rectification circuits operate at a maximum conversion efficiency for a specific input power and input impedance. A multiport radiator configured with rectification circuits operates to rectify an incoming electromagnetic RF wave to DC power.

By digitally selecting the number of utilized slot antenna, in accordance with embodiments of the present invention as described above (e.g. by short circuiting unutilized slot antennas), and by selecting the number of rectification circuits operated in parallel per antenna (e.g. by open circuiting a select number of rectifiers on a particular slot in the example above), the optimum power per rectification circuit and the optimum driving point impedance on each active rectifier is maintained over a large range of incident input power levels. This allows a rectifier circuit to operate at a high conversion efficiency over a wide range of input power levels with digital control over the number of rectifier circuits in operation. An adaptive controller may in response to the incident electromagnetic power, adjust the number and arrangement of rectification circuits operated and continuously maintain a highly efficient overall operating point.

Tileable Configuration of Individual Multi-Slot Radiators

The number of multi-slot antenna radiators may be further extended by tiling (placing physically adjacent to each other) a multitude of individual multi-slot antenna radiators. For example, the effective number of coupled antennas may be increased for an integrated circuit chips by placing multiple of such chips in close proximity to each other, thus further extending the effect. This tileability may be temporary or a permanent arrangement depending on the needs. For antennas other than slot antennas, it can be beneficial to tile individual multi-port radiators in several dimensions (e.g. horizontally and vertically).

Fabrication of Individual Multi-Slot Radiators on the Same Semiconductor Wafer

The number of coupled radiators may be selected during the fabrication process by choosing to cut a large array of manufactured coupled radiators into smaller arrays. For example, an entire semiconductor wafer may fabricated to include closely coupled slot antennas. After the fabrication, the choice of how to dice the wafer enables the manufacture of different multi-slot radiators with varying sizes and different numbers of slot antennas.

For semiconductor processing, one choice for fabrication is to not saw the wafer at all, and, hence fabricate a wafer scale multi-slot radiator array. For example, a multi-slot radiator may be configured to radiate mainly from the side not utilized for electrical connections (the backside), and hence additional interconnections between the individual patterned multi-slot radiators, that may be coupled to form one large multi-slot radiator, may be made in the same way that individual connections to the circuit (such as power and ground connections) are made during the packaging stage of the product.

The above embodiments of the present invention are illustrative and not limitative. The above embodiments of the present invention are not limited to closely coupled slot antennas and equally apply to any other closely-coupled antenna arrays such as, for example, near-field array configurations utilizing, for example, dipole antennas, short-dipoles, shortened slots or any combinations thereof. Embodiments of the present invention are not limited to any type of amplifiers, switches and tunable loads suitable, and the like. Other additions, subtractions or modifications are obvious in view of the present disclosure and are intended to fall within the scope of the appended claims.

What is claimed is:

1. A radiator comprising N slot antennas wherein a spacing between each pair of adjacent antennas is less than a wavelength of the electromagnetic signal being transmitted or received by the radiator, wherein N is an integer equal to or greater than 2, wherein each slot antenna is driven by M amplifiers at M different drive points positioned along a length of the slot antenna, wherein M is an integer equal to or greater than one, wherein the M drive points are distributed evenly along the length of the radiator, wherein each of the M amplifiers is a differential amplifier driving a different pair of adjacent slot antennas.

2. The radiator of claim 1 wherein the spacing is equal to or less than ¾ of the wavelength of the electromagnetic signals being transmitted or received by the radiator.

3. The radiator of claim 1 wherein the spacing is equal to or less than ½ of the wavelength of the electromagnetic signals being transmitted or received by the radiator.

4. The radiator of claim 1 wherein each of the M amplifiers is controlled by an associated switch adapted to place the amplifiers in one of a short, or open or active state at any given time.

5. The radiator of claim 4 wherein the N×M switches controlling the N×M amplifiers are controlled by a digital control block generating N×M digital signals each applied to a different one of the N×M switches.

6. The radiator of claim 5 wherein each differential amplifier comprises a pair of MOS transistors generating a pair of differential voltages applied to a pair of drive points positioned along a pair of associated adjacent slot antennas.

7. The radiator of claim 6 wherein each switch is adapted to control voltages applied to gate terminals of its associated MOS transistors.

8. A method of radiating an electromagnetic signal, the method comprising:

transmitting the electromagnetic signal from N slot antennas, wherein a spacing between each pair of adjacent antennas is less than a wavelength of the electromagnetic signal being transmitted, and wherein N is an integer equal to or greater than 2; and driving each slot antenna by M amplifiers at M different drive points positioned along a length of the slot antenna, wherein M is an integer equal to or greater than one, wherein the M drive points are distributed evenly along the length of the radiator, wherein each of the M amplifiers is a differential amplifier driving a different pair of adjacent slot antennas.

9. The method of claim 8 wherein the spacing is equal to or less than ¾ of the wavelength of the electromagnetic signals being transmitted or received by the radiator.

10. The method of claim 8 wherein the spacing is equal to or less than ½ of the wavelength of the electromagnetic signals being transmitted or received by the radiator.

11. The method of claim 8 further comprising:

controlling each of the M amplifiers by an associated switch adapted to place the amplifiers in one of a short, open or active state at any given time.

12. The method of claim 11 further comprising:

controlling the N×M switches that control the N×M amplifiers by a digital control block generating N×M digital signals each applied to a different one of the N×M switches.

13. The method of claim 12 wherein each differential amplifier comprises a pair of MOS transistors generating a pair of differential voltages applied to a pair of drive points positioned along a pair of associated adjacent slot antennas.

14. The method of claim 13 wherein each switch is adapted to control voltages applied to gate terminal of its associated MOS transistors.

* * * * *